US005998122A

United States Patent [19]

Spara et al.

[11] Patent Number: 5,998,122

[45] Date of Patent: Dec. 7, 1999

[54] PHOTOGRAPHIC ELEMENT CONTAINING PYRAZOLOAZOLE MAGENTA COUPLER AND A SPECIFIC ANTI-FADING AGENT

[75] Inventors: Paul P. Spara; Stanley W. Cowan, both of Rochester, N.Y.

[73] Assignee: Eastman Kodak Company, Rochester, N.Y.

[21] Appl. No.: 09/134,567

[22] Filed: Aug. 14, 1998

[51] Int. Cl.[6] ..... G03C 1/08; G03C 7/26; G03C 7/32

[52] U.S. Cl. ..... 430/551; 430/558

[58] Field of Search ..... 430/551, 558

[56] References Cited

U.S. PATENT DOCUMENTS

| | | | |
|---|---|---|---|
| 5,017,465 | 5/1991 | Nishijima | 430/551 |
| 5,082,766 | 1/1992 | Nishijima et al. | 430/551 |
| 5,104,782 | 4/1992 | Seto et al. | 430/551 |
| 5,236,819 | 8/1993 | Kadokura et al. | 430/551 |
| 5,352,573 | 10/1994 | Seto et al. | 430/551 |
| 5,415,989 | 5/1995 | Wolff | 430/523 |
| 5,561,037 | 10/1996 | Jain et al. | 430/551 |

*Primary Examiner*—Geraldine Letscher
*Attorney, Agent, or Firm*—Arthur E. Kluegel

[57] ABSTRACT

The disclosure describes a photographic element comprising a light sensitive silver halide emulsion layer having associated therewith a magenta dye forming coupler containing an azole nucleus and a ballasted compound having Formula I,

I wherein each $R_1$ is independently selected from the group consisting of hydrogen and an alkyl, aryl, acyl and acylamino group;

L represents a linking atom or group bonded to the phenyl ring by a heteroatom;

each "a" independently represents a substituent group at least one of which is linked to the phenyl ring by an N, S, C or O atom and q is 1 to 5;

provided that the selection of L and the "a" groups results in no more than one oxygen bond to the phenyl ring.

17 Claims, No Drawings

PHOTOGRAPHIC ELEMENT CONTAINING PYRAZOLOAZOLE MAGENTA COUPLER AND A SPECIFIC ANTI-FADING AGENT

FIELD OF THE INVENTION

This invention relates to photographic elements containing a light sensitive silver halide emulsion layer having associated therewith a magenta dye forming coupler and a phenyl compound bearing a certain alcoholic group.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye.

The dyes that are formed by any color coupler during processing have a tendency to fade over time as a result of exposure to light, heat and humidity. As all three image dyes of a typical color element fade, this results in overall fading of the image over time. Since the three image dyes may not fade at the same rate, an apparent change in image color may result. Such change is particularly noticeable in the case of magenta image dye fading.

A variety of magenta dye-forming coupler types have been used in photographic materials. Among the known magenta dye-forming couplers are cyclic azoles such as pyrazolotriazoles, pyrazolobenzimidazoles, and imidazopyrazoles. These couplers contain bridgehead nitrogen 5,5 fused ring systems and include such couplers as pyrrolo[1,2-b]pyrazoles, pyrazolo[3,2-c][1,2,4]triazoles, pyrazolo[2,3-b][1,2,4]triazoles, imidazo[1,2-b]pyrazoles, imidazo[1,5-b]pyrazoles, imidazo[1,2-a]imidazoles, imidazo[1,2-b][1,2,4]triazoles, imidazo[2,1-c][1,2,4]triazoles, imidazo[5,1-c][1,2,4]triazoles and [1,2,4]triazolo[3,4-c][1,2,4]triazole. Also included are 5,5,6 fused ring systems that include such couplers as pyrazolo[3,2-6]bicycloimidazoles.

A significant disadvantage of pyrazoloazole couplers is fading of the image dyes formed upon photographic processing due to extended exposure to low levels of light. Compounds which are included in photographic elements to reduce image dye fading are known as stabilizers or anti-fade agents. Inclusion of stabilizers in color photographic materials can reduce the deterioration of the dye images which occur over time as a result of the action of light, heat or humidity. This is true for dyes formed from pyrazoloazole couplers. U.S. Pat. Nos. 5,236,819, 5,561,037, and 5,082,766 and German Published Patent Application OLS 4,307,194 describe the use of certain stabilizers with pyrazoloazole couplers to improve their dye stability. However, it is desirable to further improve the light stability of dyes derived from azole magenta dye forming couplers, and thus retain the color rendition of the image for a longer period of time.

A problem to be solved is to provide a photographic element that will yield magenta dye images that have low fading when exposed to light.

SUMMARY OF THE INVENTION

The invention provides a photographic element comprising a light sensitive silver halide emulsion layer having associated therewith a magenta dye forming coupler containing an azole nucleus and a ballasted compound having Formula I,

I

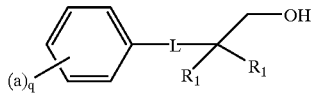

wherein each $R_1$ is independently selected from the group consisting of hydrogen and an alkyl, aryl, acyl and acylamino group;

L represents a linking atom or group bonded to the phenyl ring by a heteroatom;

each "a" independently represents a substituent group at least one of which is linked to the phenyl ring by an N, S, C or O atom and q is 1 to 5;

provided that the selection of L and the "a" groups results in no more than one oxygen bond to the phenyl ring.

Photographic elements of the present invention yield magenta dye images that have low fading when exposed to light.

DETAILED DESCRIPTION OF THE INVENTION

A formula for compound I is represented by Formula I,

I

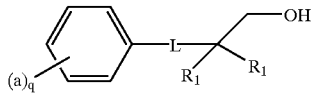

wherein each $R_1$ is independently selected from the group consisting of hydrogen and an alkyl, aryl, acyl and acylamino group;

L represents a linking atom or group bonded to the phenyl ring by a heteroatom;

each "a" independently represents a substituent group at least one of which is linked to the phenyl ring by an N, S, C or O atom and q is 1 to 5;

provided that the selection of L and the "a" groups results in no more than one oxygen bond to the phenyl ring.

L is any group suitable for linking the ethoxy substituent to the phenyl ring through a heteroatom or group. Examples include —O—, —OP(O)(OR)O—,—. —CONR—, —NRCO—, —$NRSO_2$—. —$SO_2NR$—, and —$SO_2$—, in which R is an alkyl of aryl group. L may also include such groups having alkylene, arylene, or hetero groups such as ether groups in the group L.

The group(s) "a" may be any substituent group. Substituent groups may be any of the groups defined hereinafter. There is present at least one "a" group that is bonded to the phenyl ring by an N, S, C or O atom, provided that the selection of L and the "a" groups results in no more than one oxygen bond to the phenyl ring. Particularly suitable is an "a" group where the link to the phenyl ring is —$NHSO_2$—. An example is:

I-A
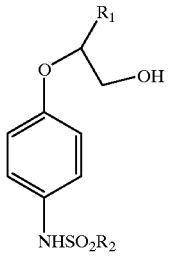
wherein: $R_1$ and $R_2$ are alkyl groups having a total of 9–30 carbon atoms.
More specifically, the following compound is useful.
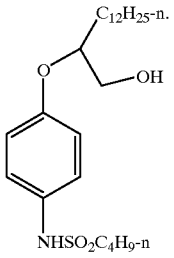
Representative examples of the stabilizers of formula I arc as follows where Me is methyl, Et is ethyl, Bu is butyl and Ph is phenyl:
I-1
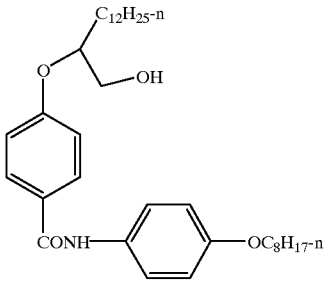
I-2
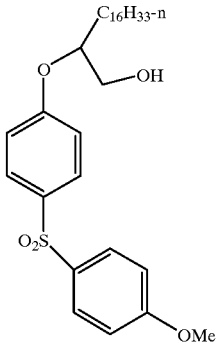
-continued
I-3
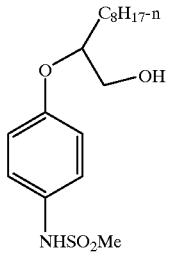
I-4
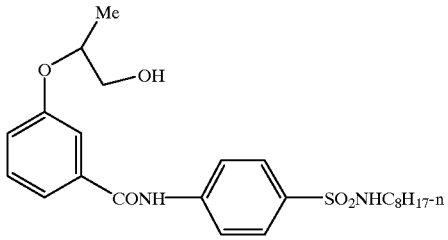
I-5
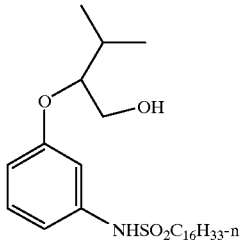
I-6
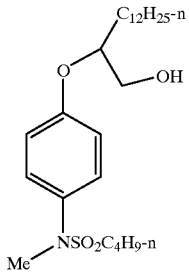
I-7
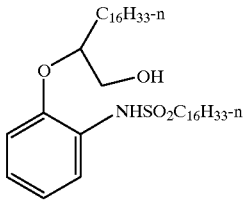
I-8
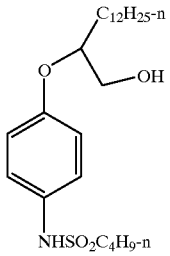

-continued
I-9
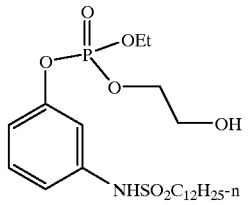
I-10
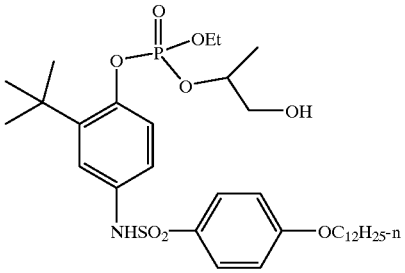
I-11
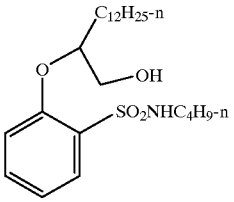
I-12
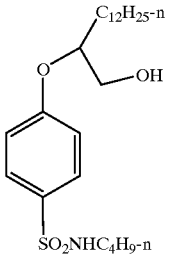
I-13
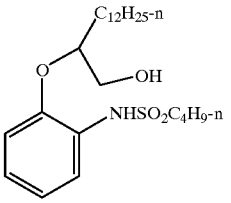
I-14
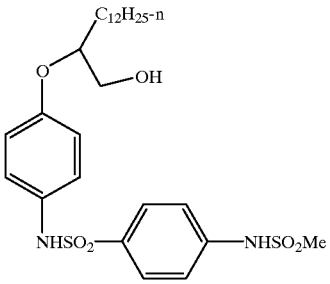
-continued
I-15
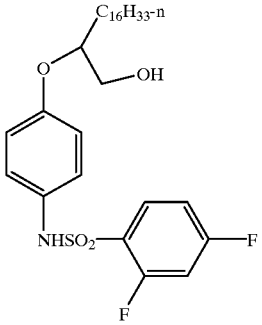
I-16
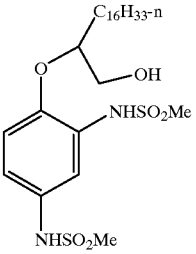
I-17
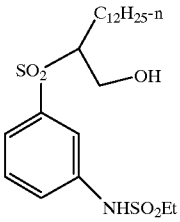
I-18
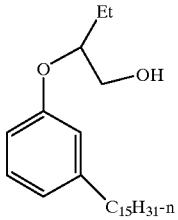
I-19
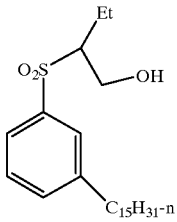
I-20
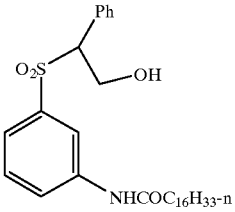

-continued
I-21
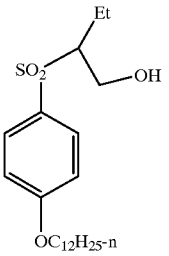
I-22
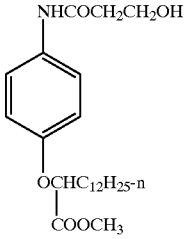
I-23
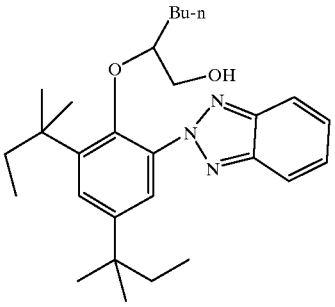
I-24
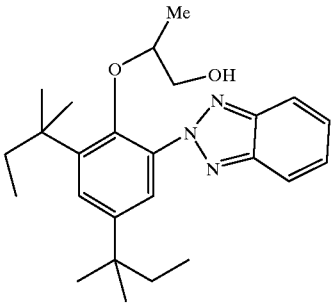
I-25
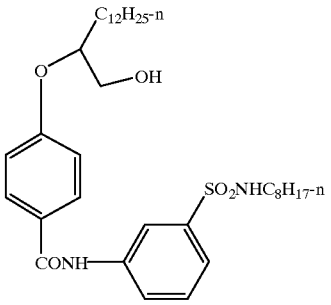
-continued
I-26
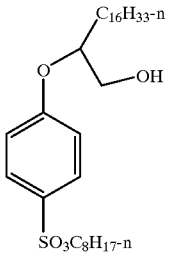
I-27
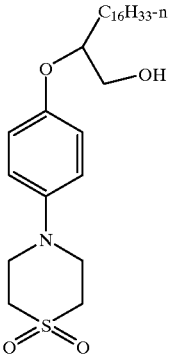
I-28
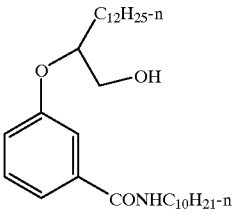
I-29
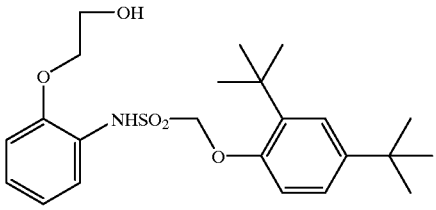
I-30
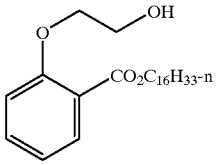
I-31
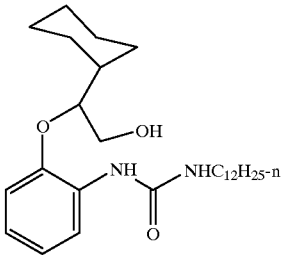

-continued

I-32

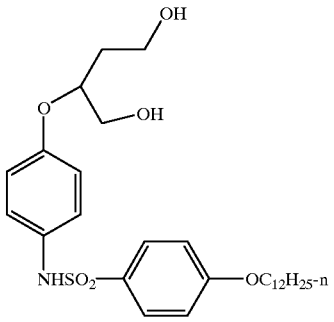

I-33

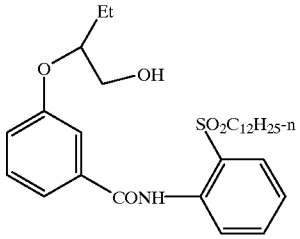

I-34

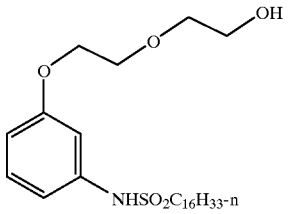

We have found that highly stable magenta dye images formed from azole magenta couplers can be obtained if there is associated with the coupler a combination of stabilizer compounds I and S, shown below, and more suitably a combination of stabilizer compounds I, S, and R, shown below.

Formula S is as follows:

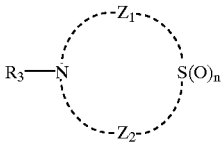

wherein:

$R_3$ represents an aryl group or a heterocyclic group;

$Z_1$ and $Z_2$ each represent an alkylene group having 1 to 3 carbon atoms provided that the total number of carbon atoms in the ring is 3 to 6; and n is an integer of 1 or 2;

The stabilizers that have the Formula S are believed to stabilize by acting as singlet oxygen quenchers. In this formula the aryl and heterocyclic group represented by $R_3$ include phenyl, 1-naphthyl, 2-furyl and 2-thienyl groups. They can be substituted with groups described hereinafter for Formula III for $R_6$, as can be the alkylene groups represented by $Z_1$ and $Z_2$.

Preferred stabilizers represented by Formula S, are those having the following Formula S1:

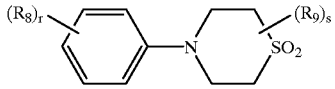

wherein:

$R_8$ represents halogen or alkyl, alkoxy, alkylthio, amido, or ureido groups;

$R_9$ is alkyl;

r is an integer of 1 or 2; and s is an integer of 0 to 4.

Representative examples of stabilizer having Formula S are:

S-1

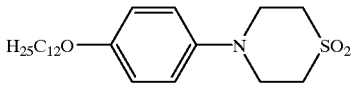

S-2

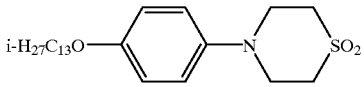

S-3

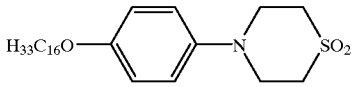

S-4

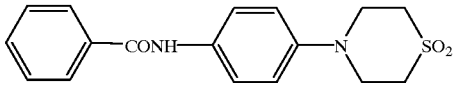

S-5

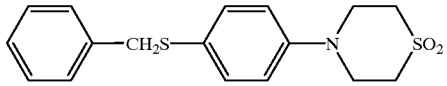

S-6

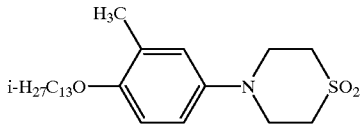

S-7

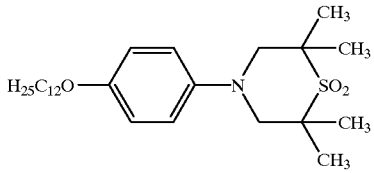

S-8

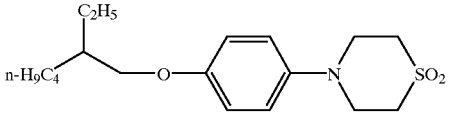

Formula R is as follows:

R

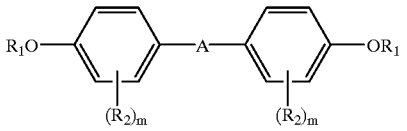

wherein:

each $R_1$ independently represents a hydrogen atom, an alkyl group, an alkenyl group or an aryl group;

each $R_2$ independently represents a halogen atom, an alkyl group, an alkenyl group an alkoxy group, an aryl group, an aryloxy group, an alkylthio group, an aryl thio group, an acyl group, an an acylamino group, a sulfonyl group, a sulfonamide group or a hydroxy group;

each m is, individually an integer of 0 to 4; and

A represents an alkylene group having 1 to 6 carbon atoms in its linear structure.

The stabilizers that have the Formula R, above, are believed to stabilize the dye image by scavenging free radicals. In this formula, the group represented by A is a straight, branched, or cyclic alkylene group, the linear portion of which has 1 to 6 carbon atoms, which includes those such groups substituted with one or more aryl, cyano, halogen, heterocyclyl, cycloalkyl, alkoxy, hydroxy, and aryloxy groups. The alkylene group can form a cycloalkyl ring, such as

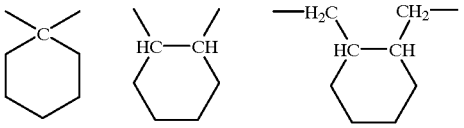

In Formula R, each $R_1$ can be a group as defined above for $R_6$ or $R_7$ in Formula III. These include halogen, alkyl, cycloalkyl, alkenyl, alkoxy, aryl, aryloxy, alkylthio, arylthio, acyl, acylamino, sulfonyl and sulfonamido groups.

Preferred compounds represented by Formula R, are those in which:

each $R_1$ is independently hydrogen or a (cyclo)alkyl group of 1 to 8 carbon atoms;

each $R_2$ is independently hydrogen, hydroxy, alkyl or alkoxy group of 1 to 8 carbon atoms;

each m is an integer of 0 to 2; and

A is an alkylene group of 1 to 10 carbon atoms.

Representative examples of stabilizer compounds which satisfy Formula R are:

R-1

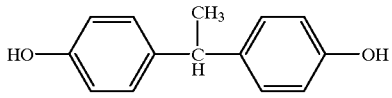

R-2

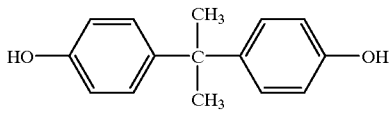

-continued

R-3

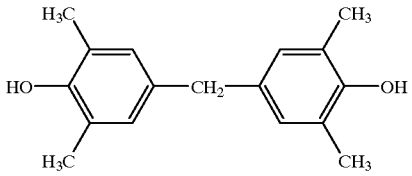

R-4

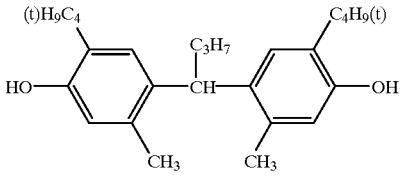

R-5

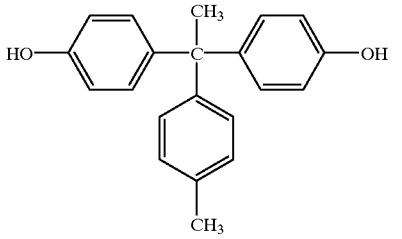

R-6

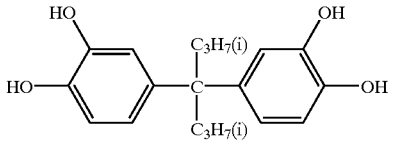

The magenta dye forming couplers of this invention can be based on any of the bridgehead nitrogen 5,5 fused ring system identified above/, Preferred couplers are pyrazolotriazoles represented by Formula II:

Formula II

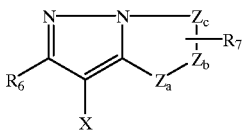

wherein:

$R_6$ is hydrogen or a substituent;

$R_7$ is a ballast group or a fused benzene ring; and

X is hydrogen or a coupling-off-group; and $Z_a$, $Z_b$, and $Z_c$ are independently a substituted or unsubstituted methine group, =N—, =C— or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it can be part of the aromatic ring and at least one of $Z_a$, $Z_b$, and $Z_c$ represents a methine group connected to $R_7$.

Preferred pyrazolotriazole couplers of this invention are 1H-pyrazolo[2,3-b][1,2,4]triazoles represented by Formula III:

Formula III

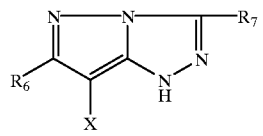

wherein:

X, $R_6$ and $R_7$ are as previously defined.

Examples of suitable $R_6$ groups are alkyl, which can be straight or branched, such as methyl, ethyl, n-propyl, n-butyl, t-butyl, trifluoromethyl, tridecyl or 3-(2,4-di-t-amylphenoxy)propyl; alkoxy, such as methoxy or ethoxy; alkylthio, such as methylthio or octylthio; aryl, aryloxy or arylthio, such as phenyl, 4-t-butylphenyl, 2,4,6-trimethylphenyl, phenoxy, 2- methylphenoxy, phenylthio or 2-butoxy-5-t-octylphenylthio; heterocyclyl, heterocyclyloxy or heterocyclylthio, each of which contain a 3 to 7 membered heterocyclic ring composed of carbon atoms and at least one hetero atom selected from oxygen, nitrogen and sulfur, such as 2-furyl, 2-thienyl, 2-benzimidazolyloxy or 2-benzothiazolyl; cyano; acyloxy, such as acetoxy or hexadecanoyloxy; carbamoyloxy, such as N-phenylcarbamoyloxy or N-ethylcarbamoyloxy; silyloxy, such as trimethylsilyloxy; sulfonyloxy, such as dodecylsulfonyloxy; acylamino, such as acetamido or benzamido; anilino, such as phenylanilino or 2-chloroanilino; ureido, such as phenylureido or methylureido; imido, such as N-succinimido or 3-benzyihydantoinyl; sulfamoylamino, such as N,N-dipropyl-sulfamoylamino or N-methyl-N-decylsulfamoylamino; carbamoylamino, such as N-butylcarbamoylamino or N,N-dimethylcarbamoylamino; alkoxycarbonylamino, such as methoxycarbonylamino or tetradecyloxycarbonylamino; aryloxycarbonylamino, such as phenoxycaronylamino, 2,4-di-t-butylphenoxycarbonylamino; sulfonamido, such as methanesulfonamido or hexadecanesulfonamido; carbamoyl group, such as N-ethylcarbamoyl or N,N-dibutylcarbamoyl; acyl, such as acetyl or (2,4-di-t-amylphenoxy)acetyl; sulfamoyl, such as N-ethylsulfamoyl or N,N-dipropylsulfamoyl; sulfonyl, such as methanesulfonyl or octanesulfonyl; sulfinyl, such as octanesulfinyl or dodecylsulfinyl; alkoxycarbonyl, such as methoxycarbonyl or butyloxycarbonyl; aryloxycarbonyl, such as phenyloxycarbonyl or 3-pentadecyloxycarbonyl; alkenyl; hydroxyl; amino; and carbonamido groups.

Typically, $R_6$ represents a tertiary alkyl group of 4 to 12 carbon atoms, desirably, t-butyl.

The ballast group represented by $R_7$ is a group of such size and configuration that, in combination with the remainder of the molecule, it provides the coupler, and the dye formed from it, with sufficient bulk that it is substantially non-diffusible from the layer in which it is coated in the photographic element. Representative ballast groups include alkyl or aryl groups containing 6 to 32 carbon atoms. Other ballast groups include alkoxy, aryloxy, arylthio, alkylthio, alkoxycarbonyl, aryloxycarbonyl, carboxy, acyl, acyloxy, carbonamido, carbamoyl, alkylcarbonyl, arylcarbonyl, alkysulfonyl, arylsulfonyl, sulfamoyl, sulfenamoyl, alkylsulfinyl, arylsulfinyl, alkylphosphonyl, arylphosphonyl, alkoxyphosphonyl, and arylphosphonyl. Preferably $R_7$ is an alkyl group of 6 to 32 carbon atoms Possible substituents for $R_6$ and $R_7$ include halogen, alkyl, aryl, aryloxy, heterocyclyl, cyano, alkoxy, acyloxy, carbamoyloxy, silyloxy, sulfonyloxy, acylamino, anilino, ureido, imido, sulfonylamino, carbamoylamino, alkylthio, arylthio, heterocyclylthio, alkoxycarbonylamino, aryloxycarbonylamino, sulfonamido, carbamoyl, acyl, sulfamoyl, sulfonyl, sulfinyl, alkoxycarbonyl, aryloxycarbonyl, alkenyl, carboxyl, sulfo, hydroxyl, amino and carbonamido groups.

The coupling off group represented by X can be a hydrogen atom or any of the coupling-off groups known in the art. Coupling-off groups can determine the equivalency of the coupler, can modify the reactivity of the coupler, or can advantageously affect the layer in which the coupler is coated or other layers in the element by performing, after the release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclythio, sulfonamido, alkylthio, arylthio, heterocyclythio, sulfonamido, phosphonyloxy, and arylazo.

Suitably, X is hydrogen or halogen. Most suitably X is hydrogen or chlorine.

Specific couplers within the scope of the present invention have the following structures:

M-1

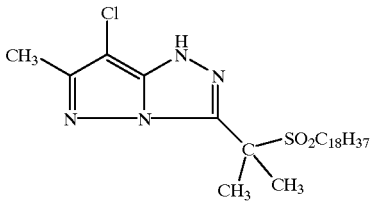

M-2

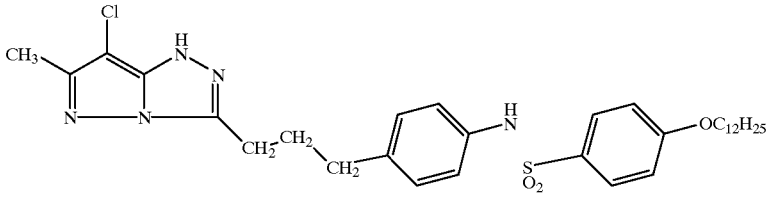

-continued
M-3
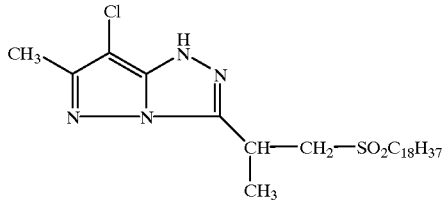
M-4
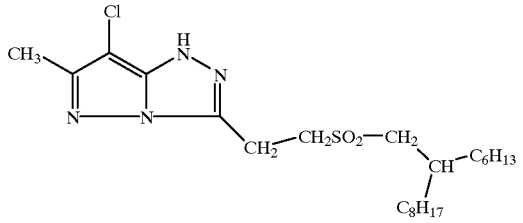
M-5
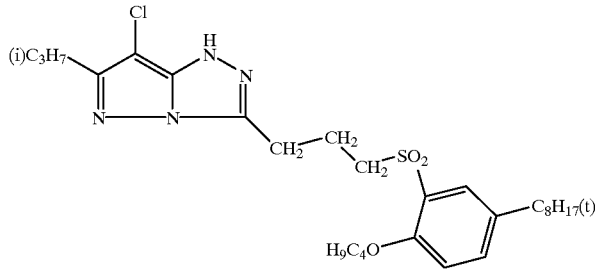
M-6
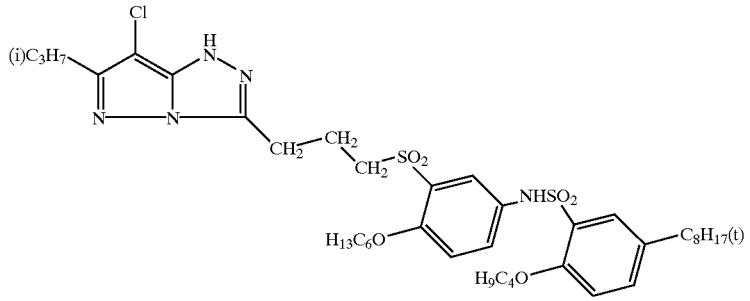
M-7
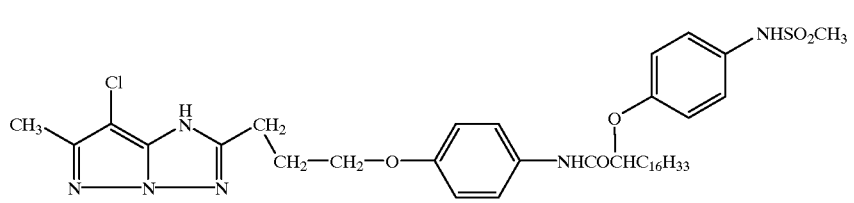
M-8
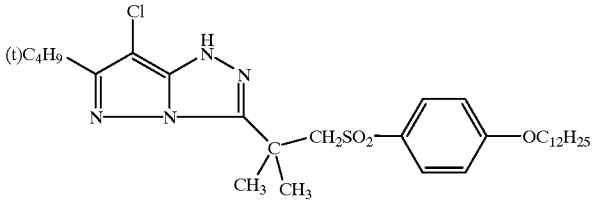

-continued
M-9
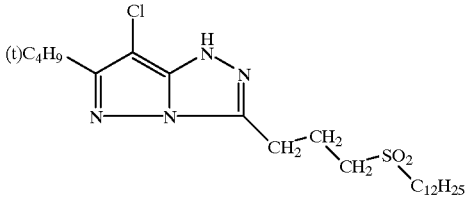
M-10
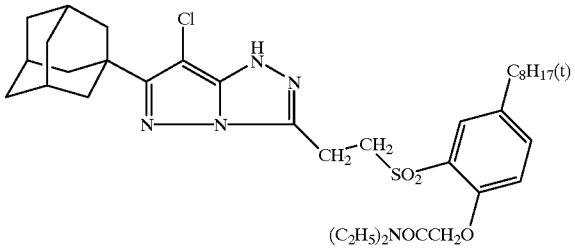
M-11
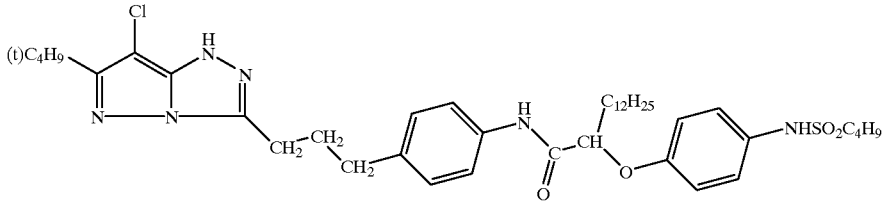
M-12
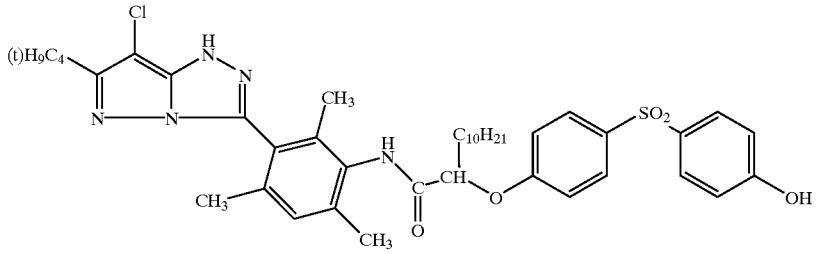
M-13
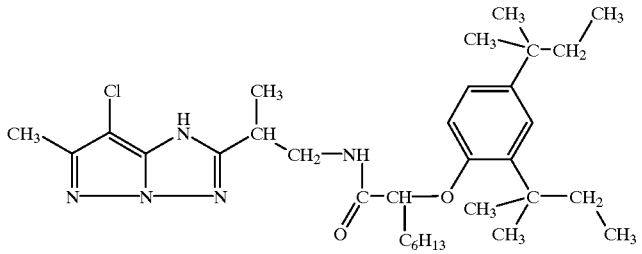
M-14
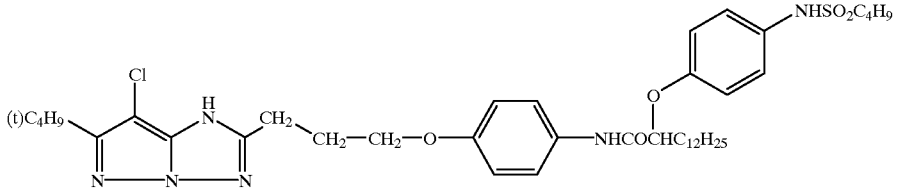

-continued

M-15

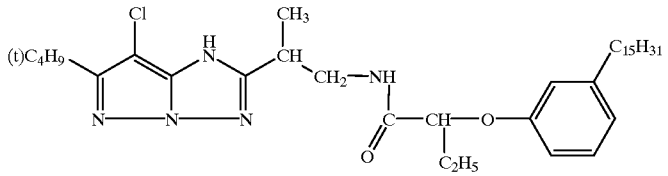

M-16

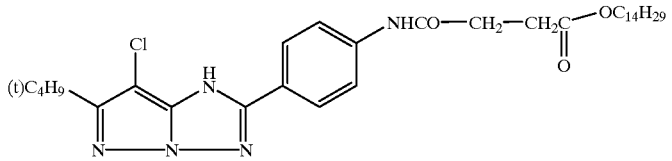

M-17

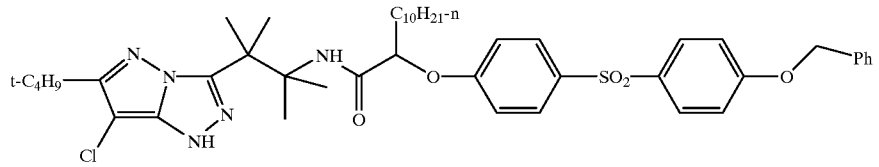

M-18

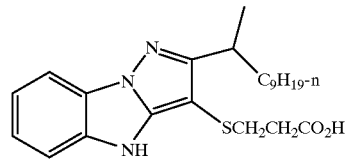

The couplers and compounds of the invention are readily manufactured as shown in the art and the synthetic example herein. See U.S. Pat. Nos. 5,561,037; 5,236,819, and 4,124, 396. The elements of the invention provide useful photographic properties such as activity, hue, stability of coupler and dye, including light and dark keeping, as well as desirable processing characteristics such as process sensitivity.

Unless otherwise specifically stated, the term substituted or substituent means any group or atom other than hydrogen bonded to the remainder of a molecule. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in thc art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in Research Disclosure, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers arc phenols, naphthols, or pyrazoloazoles.

Couplers that form magenta dyes upon reaction with oxidized color developing agent are described in such representative patents and publications as: "Farbkuppler-einc Literature Ubersicht," published in Agfa Mitteilungen, Band III, pp. 126–156 (1961) as well as U.S. Pat.s Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0489333; EPO 0512304; EPO 0515 128; EPO 0534703; EPO 0554778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Enginecring*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellcurotetrazoles or benzisodiazoles. In a preferred embodiment, the inhibitor moiety or group is selected from the following formulas:

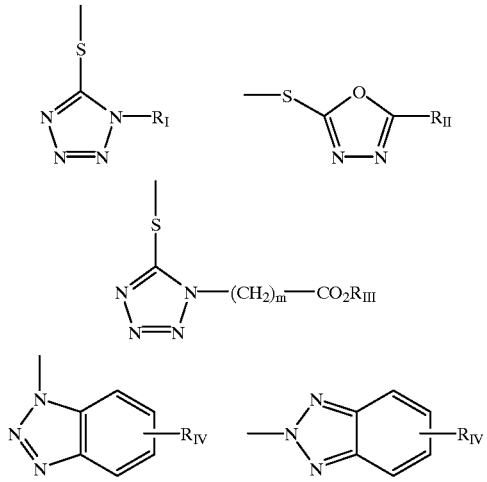

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

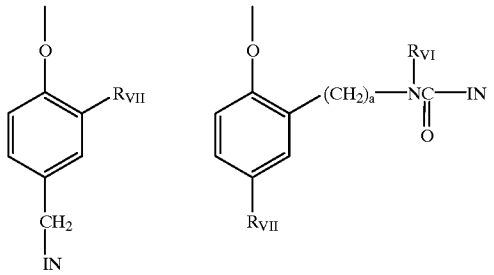

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

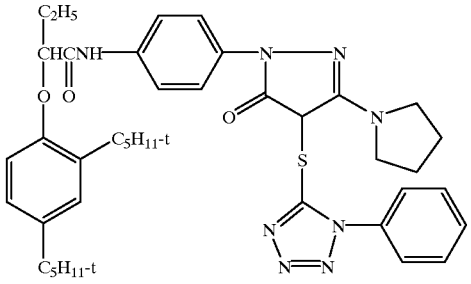

-continued

D2

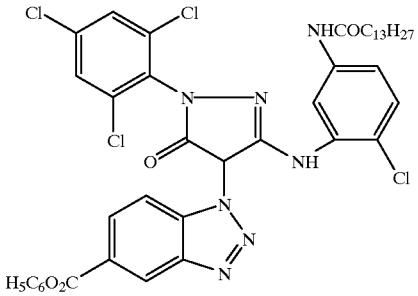

D3

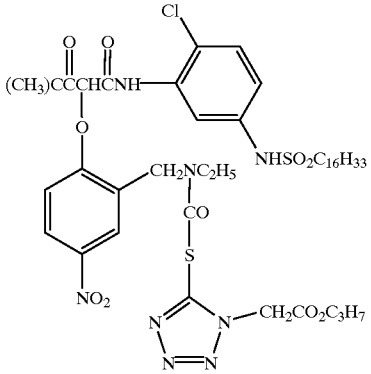

D4

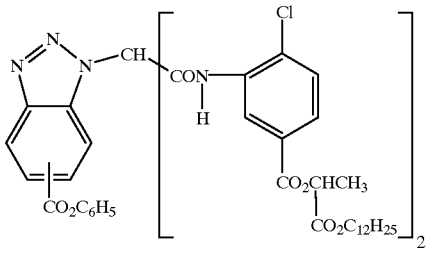

D5

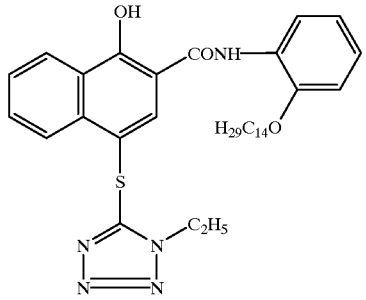

-continued
D6
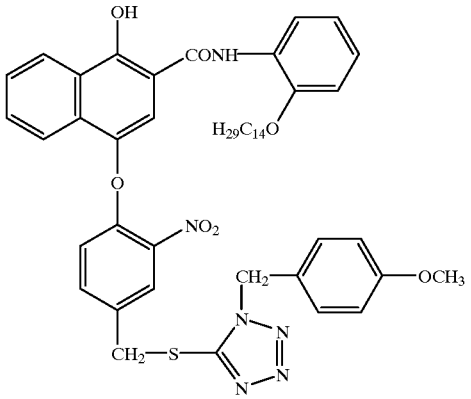
D7
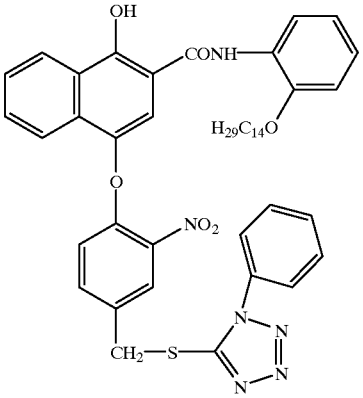
D8
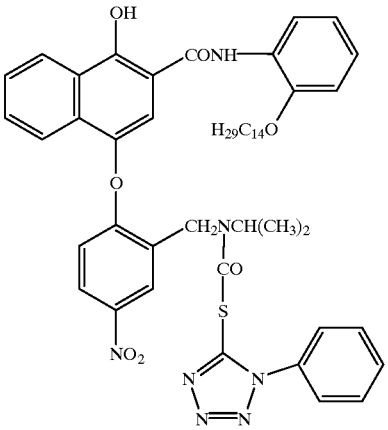
-continued
D9
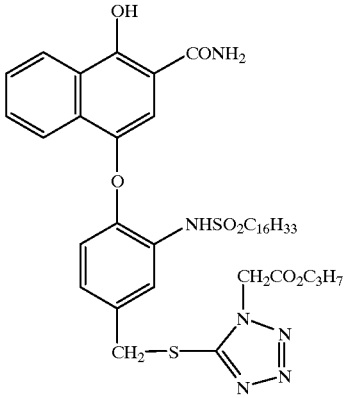
D10
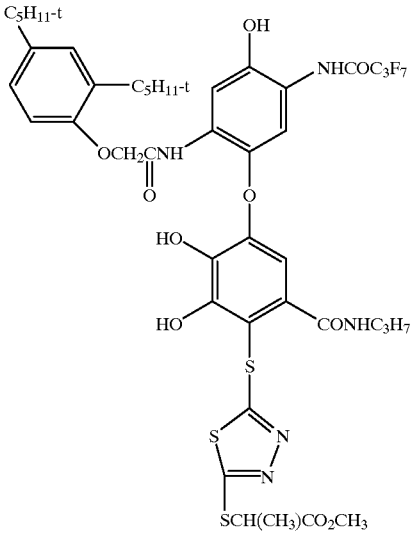
D11
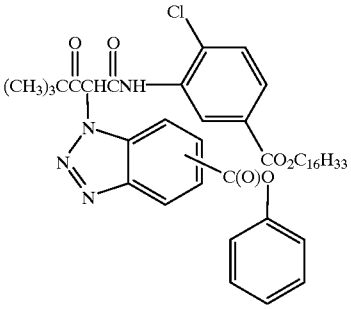
D12
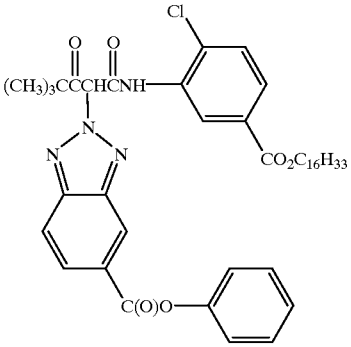

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072, 633; 90-072,634; 90-077,822; 90-078,229; 90-078,230; 90-079,336; 90-079,337; 90-079,338; 90-079,690; 90-079, 691; 90-080,487; 90-080,488; 90-080,489; 90-080,490; 90-080,491; 90-080,492; 90-080,494; 90-085,928; 90-086, 669; 90-086,670; 90-087,360; 90-087,361; 90-087,362; 90-087,363; 90-087,364; 90-088,097; 90-093,662; 90-093, 663; 90-093,664; 90-093,665; 90-093,666; 90-093,668; 90-094,055; 90-094,056; 90-103,409; 83-62,586; 83-09, 959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of of total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111 } or {100} crystal planes. The mean ECD of tabular grain emulsions rarely exceeds 10 micrometers and more typically is less than 5 micrometers.

In their most widely used form tabular grain emulsions are high bromide {111 } tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061, 609, Tsaur et al U.S. Pat. Nos. 5,147,771, '772, '773, 5,171,659 and 5,252,453, Black et al 5,219,720 and 5,334, 495, Delton U.S. Pat. Nos. 5,310,644, 5,372,927 and 5,460, 934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111 } tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111 } tabular grain emulsions are illustrated by Wey U.S. Pat. No. 4,399,215, Wey et al U.S. Pat. No. 4,414,306, Maskasky U.S. Pat. Nos. 4,400,463, 4,713, 323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111 } tabular grain emulsions are illustrated by Maskasky U.S. Pat. Nos. 5,271, 858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320, 938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustraed by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodidc emulsions coated on a transparent support and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print clement may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)ani line sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications referred to in this specification are incorporated herein by reference.

SYNTHETIC EXAMPLE

The following example illustrates the preparation of compounds of this invention. The purity of invention stabilizers were checked by (a) Thin Layer Chromatography in two or three different solvent systems of different polarity; (b) 300 MHz FT-NMR; (c) elemental analyses (C,H,N); and (d) mass spectral analysis.

The synthesis of Stabilizer 1-5 is given below:

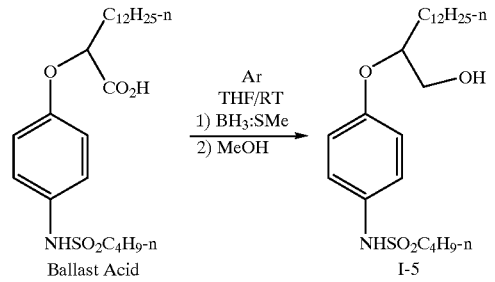

A 5 L, 3n flask equipped with a mechanical stirrer, thermometer and a pressure equalized addition funnel was charged with commercially available ballast acid (356.2 g, 781.7 mol), THF (800 mL) The resulting amber solution was let stir under an Argon atmosphere. The addition funnel was charged with a solution of borane dimethyl sulfide complex, 2M in THF (1173 mL, 3 Eqs.). The borane dimethyl sulfide complex solution was added dropwise to the ballast acid solution. A slight exotherm was observed, $T_1$=27° C. to $T_2$=35° C. The reaction vessel was cooled in an ice bath to regulate the internal temperature to a constant 30° C. throughout the addition period of 70 min. The reaction was let stir cooling to room temperature over night. An aliquot was removed and quenched into MEOH and mass spectral analysis showed (ES-) M-1=440 for desired product. The reaction vessel was cooled in a cold water bath and the addition funnel was charged with MeOH (500 mL) and was added dropwise over 1.5 hr and the resulting exotherm was controlled via cold water bath to an internal temperature of 20° C. Another 500 mL was then added at room temperature, and the resulting solution was stirred overnight. The reaction solution was then stripped on a rotary evaporator, after which the residue was redissolved in MeOH (700 mL) and stripped; this process was then repeated. The residue was dissolved in EtOAc (1 L), transferred to a separatory funnel and washed with brine (3×350 mL), sat. $NH_4Cl$ (1×350 mL), dried over $MgSO_4$, treated with decolorizing carbon, filtered and stripped to give 400 g of a clear oil which crystallized to a white solid on cooling. Solid was triturated with ligroin and collected and dried in a vacuum oven at 30° C. for 24 hr to give 320.15 g (93% yield) of a white solid, $H^1$ NMR ($CDCl_3$) which was consistent for desired structure, MS(ES-): M-1=440, mp. 49–51° C. Further purification was required to remove residual sulfide. 316.45 g of stabilizer was dissolved in 1800 mL of $Et_2O$, solution was transferred to a 5 L separatory funnel and was washed with a 8% $H_2O_2$ (3×325 mL), brine (1×500 mL), dried over $MgSO_4$, filtered through a pad of silica gel (6×15 cm), filtrate was concentrated on rotary evaporator to give a clear oil. The oil was dissolved in $Et_2O$ (700 mL) and this solution was diluted with heptane to give a total volume of 3 L. This solution was seeded and chilled in ice to give I-5, as a white crystalline solid which was collected and washed with heptane. Solid was dried in a vacuum oven at 30° C. for 24 h to give 294.0 g (93% recovery, 85% overall yield), $H^1$ NMR ($CDCl_3$): d 0.87 (q, J=7.0 Hz, 6H), 1.28 (s, 16H), 1.37 (m, 4H), 1.62 (m, 2H), 1.78 (m, 2H), 4.27 (m, 1H), 4.78 (br.s., 1H), 6.86 (d, J=1.8 Hz, 2H), 6.95 (s, 1H), 7.13 (d, J=1.8 Hz, 2H), MS(ES-): M−1=440, mp. 49–51° C. Anal. Calcd. For $C_{24}H_{43}NO_4S$: C, 65.27; H, 9.80; N, 3.17. Found: C, 65.18; H, 9.71; N, 2.95.

PHOTOGRAPHIC EXAMPLES

Preparation of Photographic Elements

Coupler M-9 and coupler solvent diundecyl phthalate were dispersed in aqueous gelatin in the following manner:

Coupler M-9 (0.406 g, $8.58\times10^{-4}$ mole) was dissolved in a mixture of diundecyl phthalate (0.686 g) and ethyl acetate (1.217 g). The mixture was heated to effect solution. After adding a solution of aqueous gelatin (21.82 g, 11.5%), diisopropylnaphthalene sulfonic acid (sodium salt) (2.51 g 10% solution), and water to make a total of 41.82 grams, the mixture was dispersed by passing it three times through a Gaulin homogenizer. This dispersion was used in the preparation of photographic element 101.

Dispersions containing the couplers and stabilizers shown for elements 102–114 in Table 1 were prepared in a similar manner. The amount of coupler in each dispersion was $8.58\times10^{-4}$ mole, the amount of each stabilizer was as listed (in moles per mole coupler), and other components were the same as in Example 101. The photographic elements were prepared as follows: On a gel-subbed, polyethylene-coated paper support were coated the following layers:

First Layer

An underlayer containing 3.23 grams gelatin per square meter.

Second Layer

A photosensitive layer containing (per square meter) 2.15 grams total gelatin, an amount of green-sensitized silver chloride emulsion containing 0.172 grams silver; the dispersion containing $5.38\times10^{-4}$ mole of the coupler indicated in Table 1; and 0.043 gram surfactant Alkanol XC (trademark of E.I. Dupont Co.)(in addition to the Alkanol XC used to prepare the coupler dispersion Third Layer A protective layer containing (per square meter) 1.40 grams gelatin, 0.15 gram bis(vinylsulfonyl)methyl ether, 0.043 gram Alkanol XC, and $4.40\times10^{-6}$ gram tetraethylammonium perfluorooctanesulfonate.

TABLE 1

| Element | Comparison or Invention | Coupler | Stabilizer(s) |
|---|---|---|---|
| 101 | Comparison | M-9 | none |
| 102 | Invention | M-9 | I-3 (2.0) |
| 103 | Invention | M-9 | I-8 (2.0) |
| 104 | Comparison | M-9 | S-8 (0.5) |
| 105 | Comparison | M-9 | S-8 (0.5)<br>C-1 (2.0) |
| 106 | Invention | M-9 | S-8 (0.5)<br>I-3 (2.0) |
| 107 | Invention | M-9 | S-8 (0.5)<br>I-8 (2.0) |
| 108 | Invention | M-9 | S-8 (0.5)<br>I-6 (2.0) |
| 109 | Invention | M-9 | S-8 (0.5)<br>I-18 (2.0) |
| 110 | Invention | M-9 | S-8 (0.5)<br>I-19 (2.0) |
| 111 | Comparison | M-17 | S-8 (0.5) |
| 112 | Invention | M-17 | S-8 (0.5)<br>I-3 (2.0) |
| 113 | Invention | M-17 | S-8 (0.5)<br>I-8 (2.0) |
| 114 | Comparison | M-13 | S-8 (0.5) |
| 115 | Invention | M-13 | S-8 (0.5)<br>I-8 (2.0) |
| 116 | Comparison | M-16 | S-8 (0.5) |
| 117 | Invention | M-16 | S-8 (0.5)<br>I-8 (2.0) |
| 118 | Comparison | M-18 | S-8 (0.5) |

TABLE 1-continued

| Element | Comparison or Invention | Coupler | Stabilizer(s) |
|---|---|---|---|
| 119 | Invention | M-18 | S-8 (0.5)<br>I-8 (2.0) |

Preparation of Processed Photographic Examples

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| 4-amino-3-methyl-N-ethyl-N-(2-methanesulfonamido ethyl)aniline sesquisulfate hydrate, | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7 C. | |

The density of each step of each strip was measured. The maximum density of the strip in response to green light was recorded as "Dmax.". The strips were then covered by UV-absorbing filters (in lieu of coating a similar filter layer over the photosensitive layer of the photographic element) and subjected to irradiation by the light of a xenon arc lamp at an intensity of 50,000 lux for 2 weeks. The light stability of the dye ("Dye Stability"), expressed as the percent of the density remaining from initial densities of 1.0 and 1.7, is shown in Table 2.

TABLE 2

| Element | Comp/Inv | Coup | Stab(s) | Dmax | Dye Stability-% remaining from 1.0 | from.1.7 |
|---|---|---|---|---|---|---|
| 101 | Comparison | M-9 | none | 2.47 | 16 | 31 |
| 102 | Invention | M-9 | I-3 | 2.46 | 71 | 75 |
| 103 | Invention | M-9 | I-8 | 2.61 | 77 | 80 |
| 104 | Comparison | M-9 | S-8 | 2.56 | 69 | 74 |
| 105 | Invention | M-9 | I-27 | 2.62 | 75 | 79 |
| 106 | Comparison | M-9 | S-8 | 2.49 | 70 | 75 |
| 107 | Comparison | M-9 | S-8 + C-1 | 2.74 | 72 | 77 |
| 108 | Invention | M-9 | S-8 + I-3 | 2.71 | 83 | 86 |
| 109 | Invention | M-9 | S-8 + I-8 | 2.70 | 84 | 88 |

TABLE 2-continued

| Element | Comp/Inv | Coup | Stab(s) | Dmax | Dye Stability-% remaining from 1.0 | from.1.7 |
|---|---|---|---|---|---|---|
| 110 | Invention | M-9 | S-8 + I-6 | 2.73 | 79 | 82 |
| 111 | Invention | M-9 | S-8 + I-18 | 2.70 | 76 | 81 |
| 112 | Invention | M-9 | S-8 + I-19 | 3.01 | 77 | 81 |
| 113 | Invention | M-9 | S-8 + I-23 | 2.78 | 71 | 82 |
| 114 | Invention | M-9 | S-8 + I-24 | 2.72 | 73 | 83 |
| 115 | Comparison | M-17 | S-8 | 2.15 | 83 | 82 |
| 116 | Invention | M-17 | S-8 + I-3 | 2.61 | 84 | 86 |
| 117 | Invention | M-17 | S-8 + I-8 | 2.68 | 87 | 89 |
| 118 | Comparison | M-13 | S-8 | 2.45 | 81 | 78 |
| 119 | Invention | M-13 | S-8 + I-8 | 2.70 | 86 | 85 |
| 120 | Comparison | M-16 | S-8 | 2.00 | 95 | 94 |
| 121 | Invention | M-16 | S-8 + I-8 | 2.64 | 98 | 98 |
| 122 | Comparison | M-18 | S-8 | 3.00 | 84 | 86 |
| 123 | Invention | M-18 | S-8 + I-8 | 3.22 | 92 | 91 |

It is clear from the data in Table 1 that the stabilizers of our invention provided substantial improvements in the light stability of the magenta image dye when used in the absence of any additional stabilizers (Examples 102–103 vs. Example 101).

The data also show that the stabilizers of the invention provided substantial improvements in the light stability of the magenta image dye when used in combination with the known stabilizer Compound S-8 (Examples 107–114 vs Example 106, and Examples 116–117 vs Example 115). Comparison stabilizer C-1 is a hydroxyalkyl compound but lacks the other required structural features of formula I, provided only slightly better stabilization in combination with S-8 than S-8 alone (Example 105 vs Example 104).

Examples 118–123 show that the stabilizers of our invention are effective with a wide range of different types of couplers that are within the scope of the invention.

Stabilizer I-27, which combines the functionalities of formula I with those of formula S, provided better light stability than Compound S-8, which lacks several of the structural features of formula I (Example 105 vs Example 104).

The data in Table 2 also show that in nearly every comparison, the elements containing the stabilizers of our invention provided significant boosts in the density of the dye formed during color development, represented by Dmax, compared to the corresponding elements that did not contain the stabilizers of our invention.

The invention has been described in detail with particular reference to certain preferred embodiments thereof, but it will be understood that variations and modifications can be effected within the spirit and scope of the invention.

What is claimed is:

1. A photographic element comprising a light sensitive silver halide emulsion layer having associated therewith a magenta dye forming coupler containing an azole nucleus and a ballasted compound having Formula I,

I

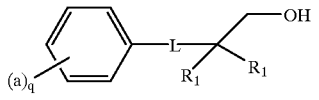

wherein each $R_1$ is independently selected from the group consisting of hydrogen and an alkyl, aryl, acyl and acylamino group;

L represents a linking atom or group bonded to the phenyl ring by a heteroatom;

each "a" independently represents a substituent group at least one of which is linked to the phenyl ring by an N, S, C or O atom and q is 1 to 5;

provided that the selection of L and the "a" groups results in no more than one oxygen bond to the phenyl ring.

2. A photographic element of claim 1, wherein said silver halide emulsion layer has associated therewith a compound having Formula S:

S

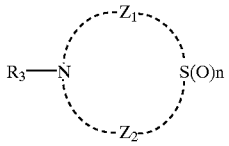

wherein:

$R_3$ represents an aryl group or a heterocyclic group;

$Z_1$ and $Z_2$ each represent an alkylene group having 1 to 3 carbon atoms provided that the total number of carbon atoms in the ring is 3 to 6;

n is an integer of 1 or 2.

3. A photographic element of claim 1, wherein said silver halide emulsion layer has associated therewith a compound having Formula R:

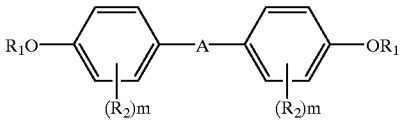

wherein:

each $R_1$ independently represents a hydrogen atom, an alkyl group, an alkenyl group or an aryl group;

each $R_2$ independently represents a substituent;

each m independently represents an integer of 0 to 4; and

A represents an alkylene group having 1 to 6 carbon atoms in its linear structure.

4. A photographic element of claim 2, wherein said silver halide emulsion layer has associated therewith a compound having Formula R:

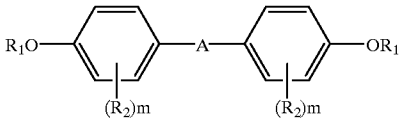

wherein:

each $R_1$ independently represents a hydrogen atom, an alkyl group, an alkenyl group or an aryl group;

each $R_2$ independently represents a substituent;

each m independently represents an integer of 0 to 4; and

A represents an alkylene group having 1 to 6 carbon atoms in its linear structure.

5. A photographic element of claim 4 wherein compound S has the structure:

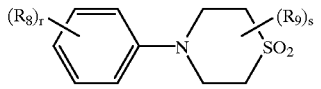

wherein:

$R_8$ represents halogen or an alkyl, alkoxy, alkylthio, amido, or ureido group;

$R_9$ is an alkyl group;

r is an integer of 1 or 2; and s is an integer of 0 to 4; and compound R has the structure:

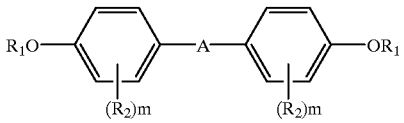

wherein each $R_1$ independently represents hydrogen, alkyl or cycloalkyl groups of 1 to 8 carbon atoms;

each $R_2$ is independently hydrogen, hydroxy, alkyl or alkoxy of 1 to 8 carbon atoms;

each m is an integers of 0 to 2; and

A is an alkylene group of 1 to 10 carbon atoms.

6. A photographic element of claim 4, wherein each of compounds S, I and R are associated with said silver halide emulsion layer in an amount in a range of about 0.2 to 2.0 moles compound per mole magenta dye forming coupler.

7. A photographic element of claim 1, said silver halide emulsion layer further having associated therewith a phthalate ester coupler solvent.

8. A photographic element of claim 1, wherein the magenta dye forming coupler has the structure:

Formula II

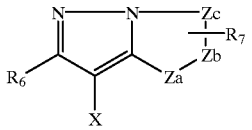

wherein:

$R_6$ is hydrogen or a substituent;

$R_7$ is a ballast group or a fused benzene ring; and

X is hydrogen or a coupling-off-group; and $Z_a$, $Z_b$, and $Z_c$ are independently a substituted or unsubstituted methine group, =N—, =C— or —NH—, provided one of either the $Z_a$—$Z_b$ bond or the $Z_b$—$Z_c$ bond is a double bond and the other is a single bond, and when the $Z_b$—$Z_c$ bond is a carbon-carbon double bond, it can be part of the aromatic ring and at least one of $Z_a$, $Z_b$, and $Z_c$ represents a methine group connected to $R_7$.

9. A photographic element of claim 4, wherein the magenta dye forming coupler has the structure:

Formula III

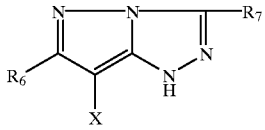

wherein:

$R_6$ is hydrogen or a substituent;

$R_7$ is a ballast group; and

X is hydrogen or a coupling-off-group.

10. A photographic element of claim 4, wherein $R_6$ is a tertiary alkyl group.

11. A photographic element of claim 1, wherein compound I has the structure:

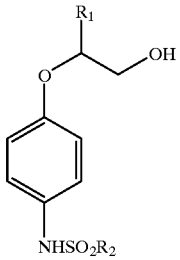

wherein:

$R_1$ and $R_2$ are alkyl groups having a total of 9–30 carbon atoms.

12. Photographic element of claim 1, wherein I has the structure:

I-8

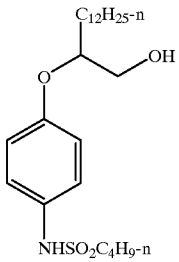

13. A photographic element of claim 1 wherein the support is opaque.

14. A photographic element of claim 1 wherein the coupler and compound I are directly dispersed in said silver halide emulsion without the use of a coupler solvent.

15. A photographic element of claim 1 that is suitable for direct viewing after development.

16. A photographic element of claim 1 wherein said silver halide emulsion comprises at least 90 mole percent silver chloride.

17. A photographic element of claim 8 wherein $R_7$ is a fused benzene ring group.

* * * * *